US006830405B2

(12) United States Patent
Watanabe

(10) Patent No.: US 6,830,405 B2
(45) **Date of Patent: *Dec. 14, 2004**

(54) FASTENING MEMBER

(75) Inventor: Morimichi Watanabe, Aichi (JP)

(73) Assignee: Nichiha Corporation, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/867,157

(22) Filed: May 29, 2001

(65) Prior Publication Data

US 2001/0045075 A1 Nov. 29, 2001

(30) Foreign Application Priority Data

May 29, 2000 (JP) ..... 2000-159070

(51) Int. Cl.[7] ..... B25G 3/08; B25G 3/26

(52) U.S. Cl. ..... 403/14; 403/13; 403/11; 52/506.05; 52/506.06; 52/546; 52/543; 411/399

(58) Field of Search ..... 52/506.06, 545, 52/546, 547, 506.08, 62, 508, 506.05, 512, 506.09, 509, 135; 403/409.1, 381, 403, 384, 386, 390, 399, 333, 331, 231, 336, 380, 230, 247, 249, 251, 252, 256, 258, 260, 334, 274, 282, 389, 14, 15, 11; 248/300, 301, 304, 220.21; 411/399

(56) References Cited

U.S. PATENT DOCUMENTS

| | | | | | |
|---|---|---|---|---|---|
| 1,240,622 | A | * | 9/1917 | Tatum | 52/547 |
| 1,714,738 | A | * | 5/1929 | Smith | 52/512 |
| 1,888,611 | A | * | 11/1932 | Wolfson | 52/512 |
| 1,909,559 | A | * | 5/1933 | Wagner | 52/520 |
| 2,182,523 | A | * | 12/1939 | Markowski | 52/547 |
| 2,495,303 | A | * | 1/1950 | Wisniewski | 52/547 |
| 3,388,518 | A | * | 6/1968 | Scott | 52/546 |
| 4,495,743 | A | * | 1/1985 | Ellison et al. | 52/478 |
| 4,570,404 | A | * | 2/1986 | Knudson | 52/520 |
| 4,599,842 | A | * | 7/1986 | Counihan | 52/586 |
| 4,977,721 | A | * | 12/1990 | Blosseville et al. | 52/410 |
| 6,237,293 | B1 | * | 5/2001 | Gembala | 52/302.6 |
| 6,354,045 | B1 | * | 3/2002 | Boone et al. | 52/95 |

FOREIGN PATENT DOCUMENTS

| | | | | |
|---|---|---|---|---|
| JP | 159189 | * | 6/1998 | 52/506.02 |
| JP | 10-169153 | | 6/1998 | E04F/13/08 |
| JP | 2000-73517 | | 3/2000 | |
| JP | 2000-213140 | | 8/2000 | |
| JP | 2000-226924 | | 8/2000 | |
| JP | 2001-27031 | | 1/2001 | |
| JP | 2001-123639 | | 5/2001 | |
| JP | 227136 | * | 8/2001 | E04B/1/61 |
| JP | 2001-311290 | | 11/2001 | |
| JP | 242347 | * | 8/2002 | 52/506.02 |

OTHER PUBLICATIONS

Patent Abstracts of Japan, Publication No. 2000–073517, Publication Date: Mar. 7, 2000, 1 page.

(List continued on next page.)

*Primary Examiner*—Phi Dieu Tran A
(74) *Attorney, Agent, or Firm*—Osha & May L.L.P.

(57) ABSTRACT

A fastening member which is designed to receive a downwardly directed component force on the occasion of fixing it to a post or a stud of a building frame, thereby preventing it from being inadvertently floated up, thus ensuring always a stably fastened state of the building board. This fastening member is featured in that the inner wall of the concave portion formed in the substrate of the fastening member is provided at a lower wall portion thereof with an obliquely projected portion which enables a downwardly directed component force to be acted on the fastening member by allowing the projected portion to be contacted with a large head portion of the fixing member at a final stage of fixing it to a post or a stud of a building frame through an opening formed in the bottom of the concave portion.

7 Claims, 9 Drawing Sheets

OTHER PUBLICATIONS

Patent Abstracts of Japan, Publication No. 2000–213140, Publication Date: Aug. 2, 2000, 1 page.
Patent Abstracts of Japan, Publication No. 2000–226924, Publication Date: Aug. 15, 2000, 2 pages.
Patent Abstracts of Japan, Publication No. 2000–027031, Publication Date: Jan. 30, 2001; 2 pages.
Patent Abstracts of Japan, Publication No. 2001–123639, Publication Date: May 8, 2001, 1 page.
Patent Abstracts of Japan, Publication No. JP10169153, Publication Date Jun. 23, 1998, 1 page.

Japanese Office Action corresponding to application No. 2000–159070, w/English translation, dated Mar. 27,2002, 4 pages.

Document Bibliography & Abstract for Japanese Patent No. JP2001–311290 publication date Nov. 9, 2001 (1 page).

Notice of Reasons for Revocation for Japanese Patent No.: 3380522 (2 pages), dated Feb. 17, 2004.

* cited by examiner

FASTENING MEMBER

BACKGROUND OF THE INVENTION

1. Field of the Invention

The present invention relates to a fastening member which is adapted to be employed in a siding work for fastening building boards such as ceramic siding boards to the side of a building frame.

2. Description of the Related Arts

As an exterior finish work of a building, a board siding work for attaching ceramic siding boards (building boards) to the side of a building frame is usually performed.

For example, as shown in FIGS. 5 and 6, in the case of wood frame construction (two-by-four construction) for example, a framework 1 is assembled at first, and after an underlayment 2 such as a plywood and a moisture permeable waterproofing sheet as desired is attached to the framework 1, ceramic building boards 40 are horizontally fastened via the underlayment 2 to the framework 1 by taking advantage of the studs 3 of the framework 1.

In this case, a first building board 40 to be disposed at the lowest portion of the framework 1 is horizontally placed at first to the framework 1 and fastened thereto using nails 4 by taking advantage of studs 3. Then, a second building board 40 to be fastened over the first building board 40 is horizontally placed with the lower rabbeted horizontal edge 40*a* of the second siding board being fitted over or engaged with the upper rabbeted horizontal edge 40*b* of the first building board 40, and then fastened to the studs 3 in the same manner as illustrated above using nails 4. Since the head 4*a* of the nail 4 employed in fastening the building board 40 is exposed in this case, thus deteriorating the external appearance or design of the finish, a coating coverage is usually subsequently applied to such an exposed head portion of the nails 4. Further, there is also a possibility that the building boards 40 may be damaged due to the nailing work.

With a view to overcome the aforementioned problems, there is also known a method of fastening building boards to the framework of a building frame by making use of a fastening member which is exclusively designed for the fastening. FIG. 8 illustrates one example of such a fastening member (Japanese Patent Unexamined Publication H10-2089). This fastening member 30 comprises a substrate 31 provided with an upstanding portion 31*a* extended rearward from the upper edge thereof and with an upstanding portion 31*b* extended rearward from the lower edge thereof, a concave portion 35 depressed rearward from the substrate 31 and having a peripheral wall 35*a*, a bottom 35*b* and an opening 35*c* formed in the bottom 35*b* for allowing a screw (a fixing member) to be screwed therein, and an engaging portion 33 which is formed contiguous to the distal end of the horizontal portion 32 extending forward from the substrate 31. In this case, the upstanding portion 31*a* extending from the upper edge of substrate 31 is extended obliquely upward and provided with openings 34*b* for driving a nail (a fixing member).

The method of fastening the building board 40 shown in FIG. 7 by making use of this fastening member 30 can be performed as explained below. In this case, all four sides of the building board 40 are respectively formed into a tongue portion for forming a shiplap joint. Specifically, the overlying tongue portion is formed at two sides thereof, i.e. a left side region extending from the left edge to a vicinity of the inner surface thereof and a lower side region extending from the lower edge to the inner surface thereof. The overlying tongue portion is consisted of an overlying tongue pattern-forming portion 41 forming the surface of board and a V-shaped groove portion 43 formed on the rear side, both portions being adapted to be piled on the underlying tongue portion. The specific configuration of the V-shaped groove portion 43 is formed such that can be engaged with the engaging portion of the fastening member to be employed.

On the other hand, the underlying tongue portion is formed at the remaining two sides thereof, i.e. a right side region extending from the pattern-forming right side edge to the vicinity of the outer side thereof and an upper side region extending from the pattern-forming upper edge to the outer side thereof. These two sides are respectively formed into an underlying tongue engaging portion 44 for receiving the overlying tongue pattern-forming portion 41 which is designed to be piled on the underlying tongue portion. Further, the specific configuration of latter underlying tongue portion is formed obliquely so as to be engaged with the engaging portion of the fastening member to be employed. Additionally, a caulking material 45 is adhered on the flat surface of both underlying tongue portions.

First of all, as shown in FIG. 9, the lower building board 40B is horizontally fastened. Then, the fastening member 30 is contacted with the studs 3 in such a manner that the lower portion of the engaging portion 33 of the fastening member 30 is engaged with the underlying tongue engaging portion 44 of the building board 40B. Then, a screw 5*c* (fixing member) is screwed into the studs 3 through the opening 35*c*, or a screw 5*a* (fixing member) is screwed into there through the opening 34*a*, or a nail (fixing member) is driven into there through the opening 34*b*, thereby fixing the fastening member 30 to the framework of a building.

Then, the V-shaped groove portion 43 of the next upper building board 40A is engaged with the upper side of the engaging portion 33 of the fastening member 30 that has been fixed in advance to the framework, thereby horizontally positioning this upper building board 40A along the studs 3. Then, in the same manner as described above, the next fastening member 30 is engaged with the underlying tongue engaging portion 44 of the building board 40A, and then, fixed to the studs 3 by making use of screws or nails. Thereafter, the same work as described above are repeated to attach the building boards 40 horizontally and in multi-stage to the side of a building frame, thereby accomplishing a decorative external sidewall.

When an underlying member (the studs 3) to which the aforementioned fastening member 30 is to be fixed is formed of a wooden member, the fixing member (nail) 5*b* can be inserted into the opening 34*b* formed in the obliquely extended upper upstanding portion 31*a* and driven obliquely downward into the studs 3, thereby fixing the fastening member 30 thereto. On this occasion, a component force directed downward is acted on the fastening member 30 to thereby push it downward. As a result, the fastening member 30 is caused to be positioned and fixed so as to enable it to firmly hold the building board 40B without leaving any gap between the building board 40B and the fastening member 30. However, when an underlying member (the studs 3) to which the aforementioned fastening member 30 is to be fixed is formed of a steel frame, the fastening member 30 is usually fixed by the screw 5*a* (fixing member) using the opening 34*a*, or fixed by the screw 5*c* (fixing member) using the opening 35*c*, in that case, the screwing into the steel frame is horizontal, because it is impossible to obliquely screwing the fixing member such as screw into the steel frame by making use of a power tool.

When the fixing member 5*a* is horizontally screwed into the steel frame from the opening 34*a* formed in the contacting portion 31*d,* it is impossible to enable a downwardly directed component force to be acted on the fastening member 30. Further, the plan view of a portion between the peripheral wall 35*a* constituting a cone-shaped concave portion 35 and the bottom 35*b* of the concave portion 35 is circular in general, and further, with a view to smoothing the screwing work, the minimum diameter of the concave portion 35 is made larger than the diameter of the diametrically large head portion 5*d* of fixing member 5*c* so as to prevent the head portion 5*d* of fixing member 5*c* from being contacted with the peripheral wall 35*a* on the occasion of screwing a screw as shown in FIG. 9. Therefore, even though the screwing work can be performed smoothly, it is impossible, when the fixing members 5*c* is horizontally screwed into the steel frame from the opening 35*c* formed in the concave portion 35, to enable a downwardly directed component force to be acted on the fastening member 30 as in the case where the fixing member (nail) 5*b* is driven obliquely downward into the underlying member.

Therefore, the fastening member 30 may be caused to float on the occasion of fixing it after it has been once positioned in place, because of a fairly large vibration generating from a power tool to be employed in the screwing work. When such a floating of the fastening member 30 is caused to generate, the fastening state between the fastening member 30 and the lower building board 40B becomes undesirably loosened, thus necessitating the worker to take a careful attention in the fastening work of the fastening member 30.

SUMMARY OF THE INVENTION

Therefore, an object of the present invention is to overcome aforementioned problems that may be encountered in the case of the conventional fastening member, and more specifically, to provide a fastening member which enables a downwardly directed component force to be acted on the fastening member at the final stage of screw-fixing the fastening member to an underlying member, thereby making it possible to push the lower building board (siding board) downward and to ensure a strongly fastened state of the building board.

With a view to realize the aforementioned objects, the present invention provides a fastening member which comprises; a substrate provided with an upstanding portion extended rearward from the upper edge thereof and with an upstanding portion extended rearward from the lower edge thereof; a concave portion depressed rearward from the substrate for fixing the fastening member to the building frame and having an inner wall, a bottom and an opening formed in the bottom for allowing a fixing member to pass therethrough; a horizontal portion extending forward from the substrate; and an engaging portion which is formed contiguous to the distal end of the horizontal portion; wherein said inner wall of the concave portion is provided at a lower wall portion thereof with an obliquely projected portion which enables a component force directed downward to be acted via the fastening member on an lower building board which is held below said horizontal portion by allowing said obliquely projected portion to be contacted with a diametrically large head portion of the fixing member at a final stage of fixing the fixing member to the side of a building frame on an occasion of fixing the fixing member to a post or a stud of a building frame through said opening formed in said bottom.

According to the fastening member of the present invention which is constructed as explained above, even if a fixing member such as screw is horizontally screwed into a post or a stud of a building frame by making use of a power tool, it is possible to give a downwardly directed component force to the fastening member through the aforementioned obliquely projected portion. Further, the fixing member functions as a substantial steady point, the fastening member is ultimately left remained in a downwardly urged state. As a result, the fixing member would not be inadvertently floated up by the vibration to be generated on the occasion of screwing the fixing member, and at the same time, building boards can be firmly fastened by the fastening member. The inner wall of the concave portion is configured into a cylindrical inner wall as a whole, and the obliquely projected portion may be a projection formed at a lower end portion of the cylindrical inner wall which is located in the vicinity of the bottom of the concave portion. Alternatively, the inner wall of the concave portion is configured into a conical inner wall as a whole, and the obliquely projected portion may be a lower portion thereof whose inclination angle is partially altered. Either of these configurations would be capable of achieving the object aimed at by the present invention.

Additionally, when the fastening member of the present invention is employed, the building boards can be firmly joined together with each other, thereby making it possible to effectively inhibit the generation of disengagement between the building boards, thus bringing about a secondary effect of preventing the generation of leakage of water through a gap between the building boards thus joined.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Preferable embodiments of the fastening member according to the present invention will be explained in details below with reference to the drawings.

Figure 1:
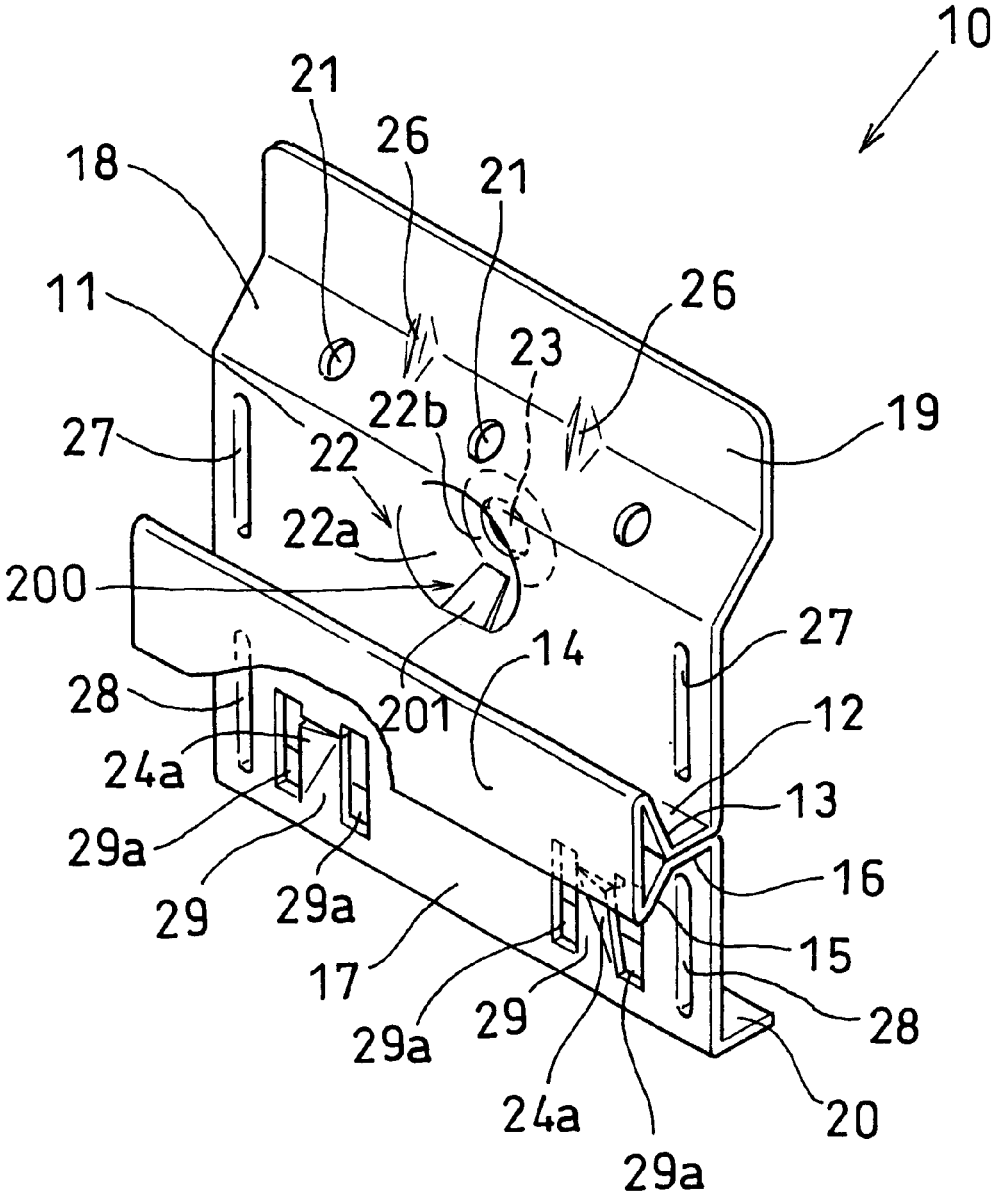
FIG. 1 is a perspective view illustrating a fastening member representing one embodiment of the present invention.

This fastening member 10 shown as a perspective view thereof in FIG. 1 is formed of a rectangular metal plate made of iron or stainless steel for instance and worked into a prescribed configuration through a continuous bending work. Specifically, the fastening member 10 comprises a first substrate portion 11, a first horizontal portion 12 which is formed through the bending of the metal plate at the first substrate portion 11 by an angle of about 90 degrees to cause the first horizontal portion 12 to extend horizontally from the first substrate portion 11, a first inclined plane 13 which is formed through the bending of the metal plate at the distal end of the first horizontal portion 12 in an obliquely upward direction, a vertical flat plate portion 14 which is formed through the bending of the metal plate at the distal end of the first inclined plane 13 in a perpendicularly downward direction, a second inclined plane 15 which is formed through the bending of the metal plate at the lower end of the vertical flat plate portion 14 in an obliquely upward direction, a second horizontal portion 16 which is formed through the bending of the metal plate at the upper edge portion of the second inclined plane 15 in the horizontal direction, and a second substrate portion 17 which is formed through the bending of the metal plate at the rear end of the second horizontal portion 16 in the vertical downward direction.

As shown in FIG. 1, the first substrate portion 11 and the second substrate portion 17 are substantially flush with each other as far as the vertical direction is concerned, thereby constituting the substrate of the fastening member 10. Further, the first horizontal portion 12 and the second horizontal portion 16 are substantially the same in width, and substantially closely contacted with each other to form a laminated structure. This portion constitutes the horizontal portion perpendicularly extended from the substrate.

Further, the first inclined plane 13 and the second inclined plane 15 constitute, together with the vertical flat plate portion 14, a closed triangular space in cross-section, thereby constituting an engaging portion at the distal end of the horizontal portion. Although not shown in the drawing, the first horizontal portion 12 and the second horizontal portion 16 may be integrally fuse-bonded by means of spot welding.

Further, an upstanding portion (an upstanding portion extended from the upper edge of the first substrate portion 11) 18 inclined rearward and a contacting portion 19 formed contiguous to the upstanding portion 18 are formed contiguous to the top of the first substrate portion 11, while an upstanding portion (an upstanding portion extended from the lower edge of the second substrate 17) 20 bent rearward by an angle of 90 degrees is formed contiguous with the lower end of second substrate portion 17. The upstanding portion 18 is provided with an opening 21 (though not essential) to be utilized as a hole for nailing on the occasion of fixing a building board to a post or a stud of a building frame. In this case, the length of the upstanding portion 20 is substantially equivalent to the distance between the first substrate portion 11 and the contacting portion 19.

Additionally, ribs 26 extending vertically are formed at the junction between the inclined upstanding portion 18 and the contacting portion 19 for the purpose of improving the mechanical strength of the fastening member. Additionally, for the purpose of improving the mechanical strength of the substrate portion, depressed grooves 27 and 28, each extending vertically, are respectively formed on both sides of the first substrate portion 11 as well as on both sides of the second substrate portion 17.

A couple of rectangular cantilever portions 29 each of which is formed from a cantilever-like cut with the upper portion thereof being constituted by a free end are formed on the right and left sides of the second substrate portion 17. The distal end portions of the cantilever portions 29 are bent obliquely upward, the bending directions thereof being opposite from each other, thereby respectively forming a triangular cut and raised portion 24*a* which is projected toward the engaging portion. On both sides of the rectangular cantilever portion 29, a rectangular hole 29*a* is formed, respectively.

Additionally, a depressed portion 22 which is depressed rearward is integrally formed at approximately the central portion of the first substrate portion 11, and is provided in the bottom thereof with a concave portion. This depressed portion 22 is constituted by an inner wall 22*a* having a conical configuration as a whole, a plane plate-like bottom 22*b* and an opening 23 formed at the central portion of the bottom 22*b*. The depth of the depressed portion 22 is approximately identical with the plane to be formed by connecting the distal end of the upstanding portion 20 with the contacting portion 19.

Figure 2A:
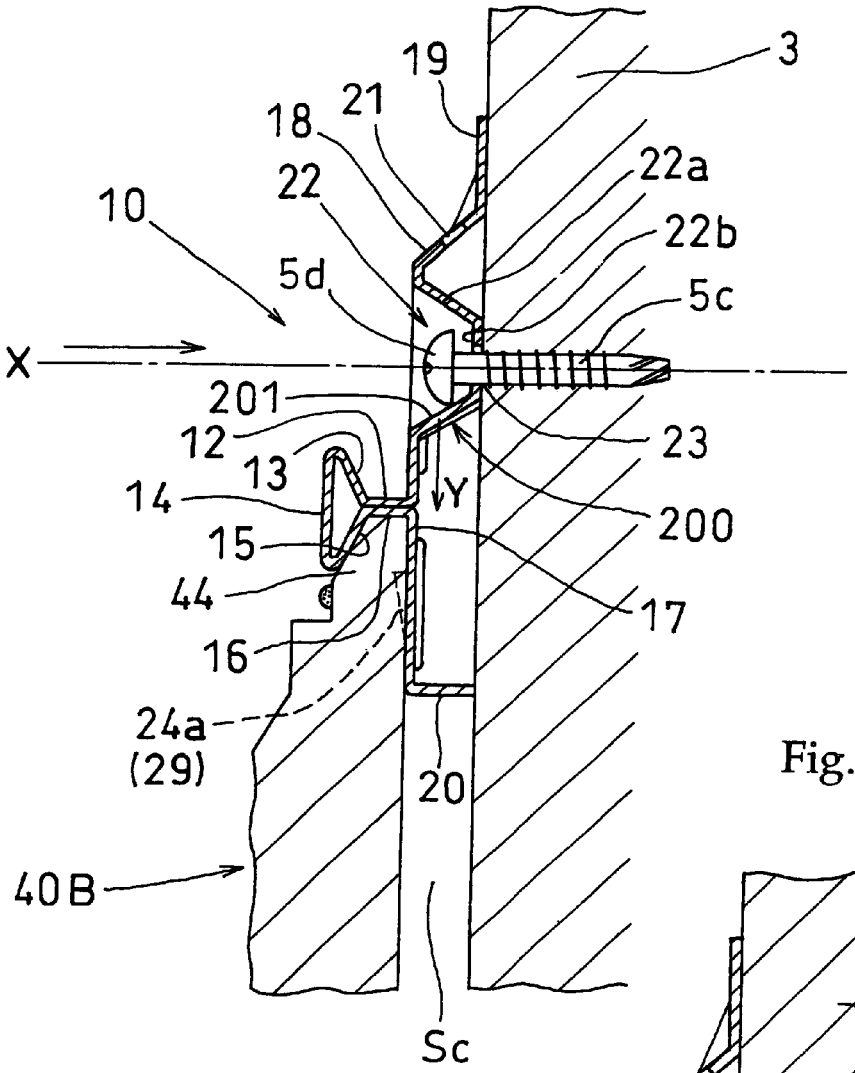
FIG. 2*a* is an elevational sectional view illustrating the manner of using the fastening member shown in FIG. 1.
Figure 2B:
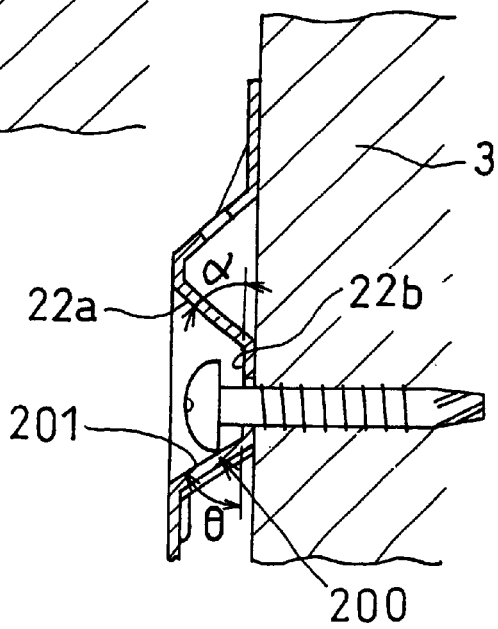
FIG. 2*b* is an enlarged sectional view illustrating part of the fastening member shown in FIG. 1.

The cross-section taken along the direction perpendicular to the axial line X of the inner wall 22*a* having a conical configuration, and, as shown in FIG. 2, the minimum diameter of the cross-section (i.e. the diameter at the position where the inner wall 22*a* intersects with the bottom 22*b*) is made larger than the diameter of the diametrically large head portion 5*d* of the fixing screw 5*c*. The conical inner wall 22*a* of the depressed portion 22 is provided at a lower wall portion thereof with a projected portion 200 adapted to be contacted with a diametrically large head portion 5*d* of the fixing screw 5*c* at a final stage of screwing the fixing screw 5*c* to a post or a stud of a building frame on an occasion of horizontally screwing the fixing screw 5*c* to a post or a stud of a building frame through the opening 23. The top surface 201 of projected portion 200 is formed of an oblique smooth surface. As shown in the partial enlarged view of FIG. 2*b*, the angle θ of inclination between the top surface 201 of projected portion 200 and the bottom 22*b* may be the same with or different from the angle α of inclination between conical inner wall 22*a* and the bottom 22*b*. It has been experimentally determined that the inclination of top surface 201 of projected portion 200 should preferably be in the range of θ=about 45 to 65 degrees.

Figure 3:
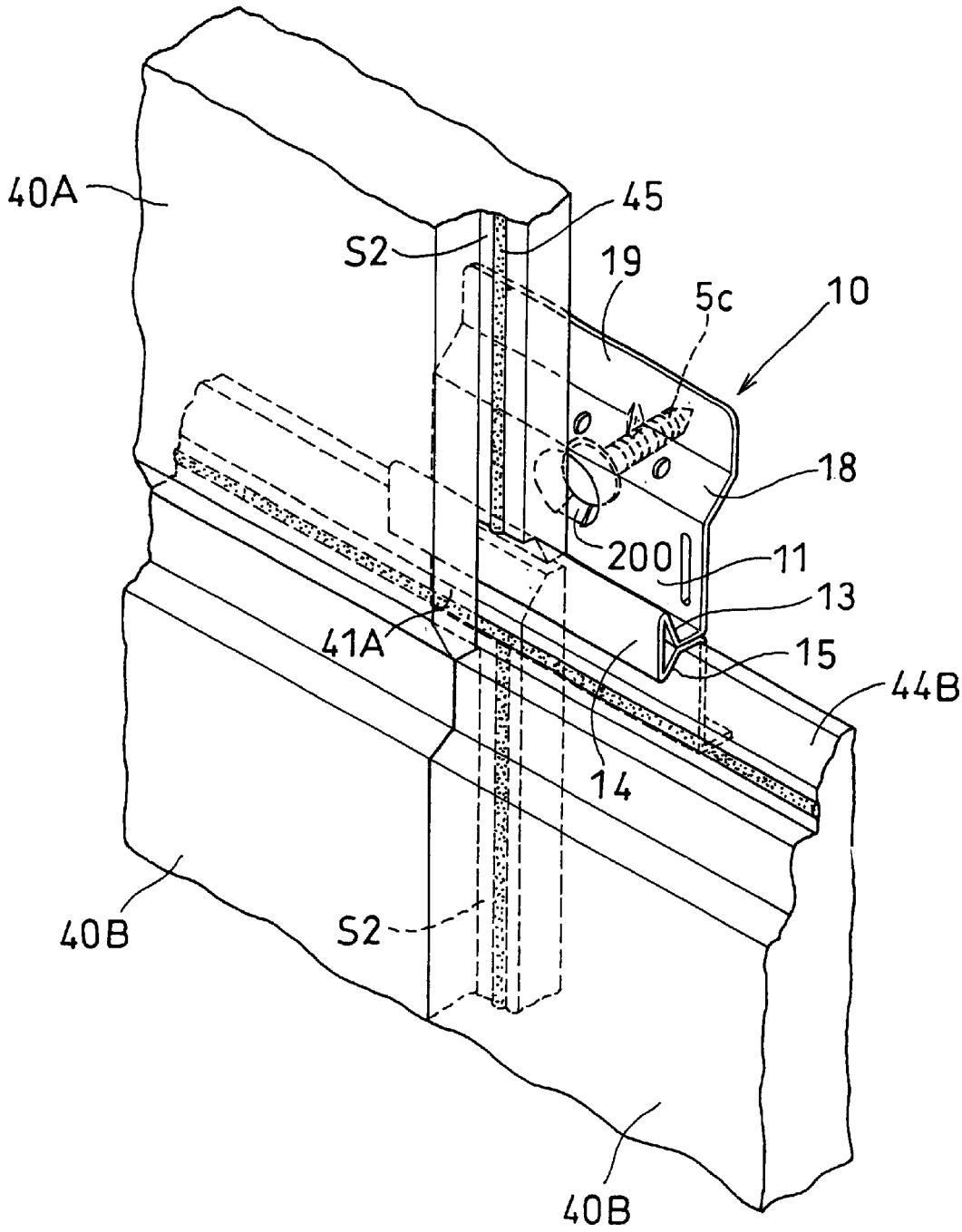
FIG. 3 is a perspective view illustrating the manner of using the fastening member shown in FIG. 1.
Figure 7:
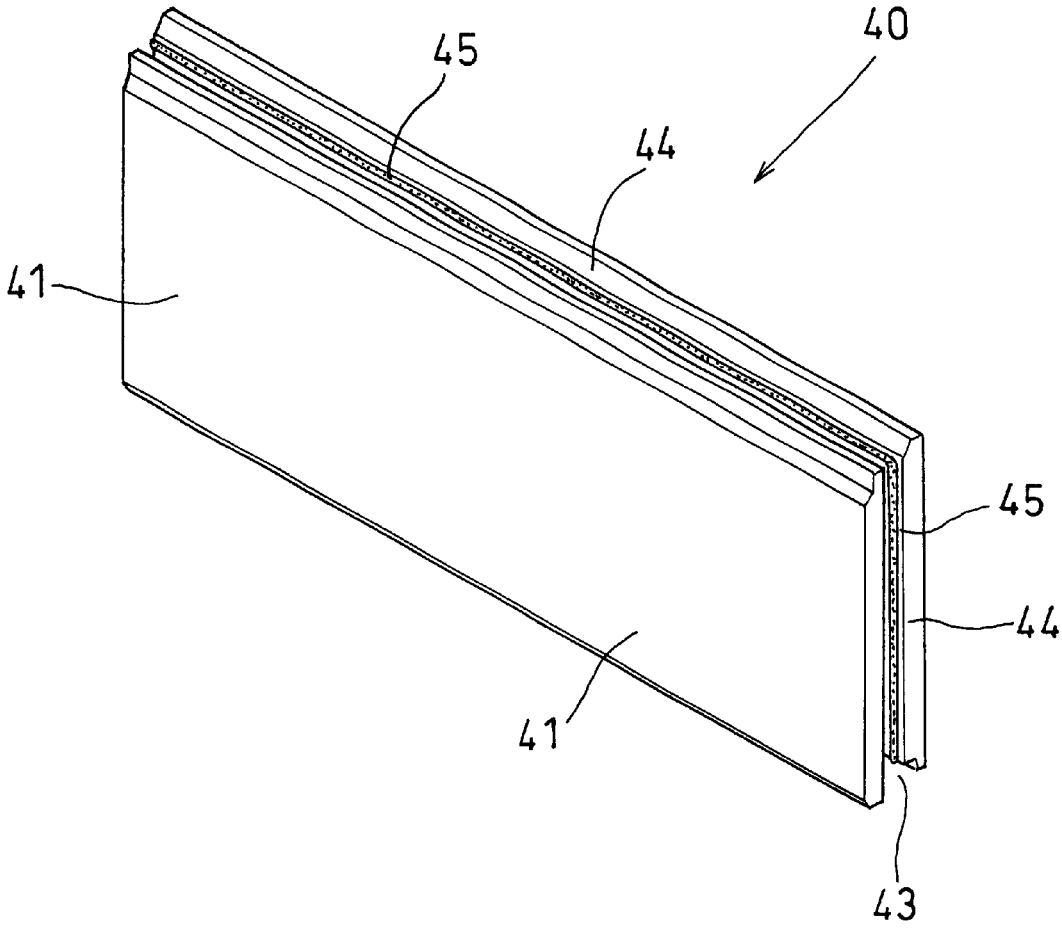
Fig. 7 Prior Art
FIG. 7 is a perspective view illustrating one example of a building board.
Figure 8:
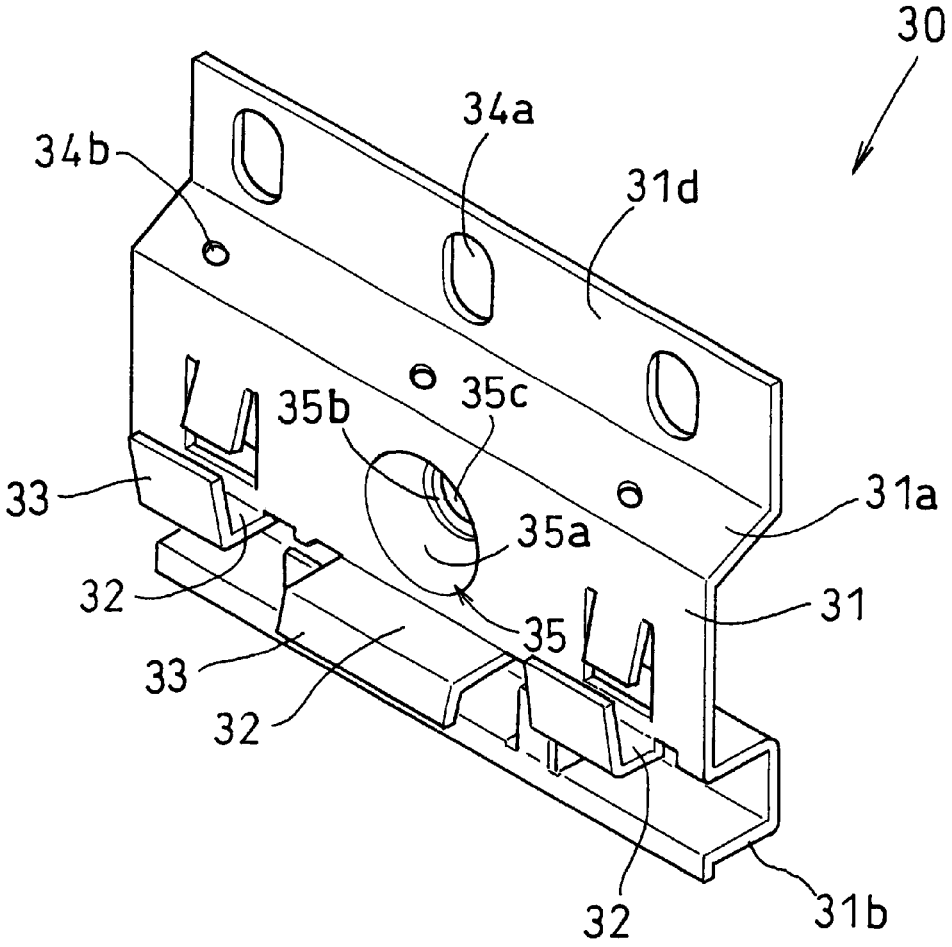
Fig. 8 Prior Art
FIG. 8 is a perspective view illustrating a fastening member according to the prior art.
Figure 9:
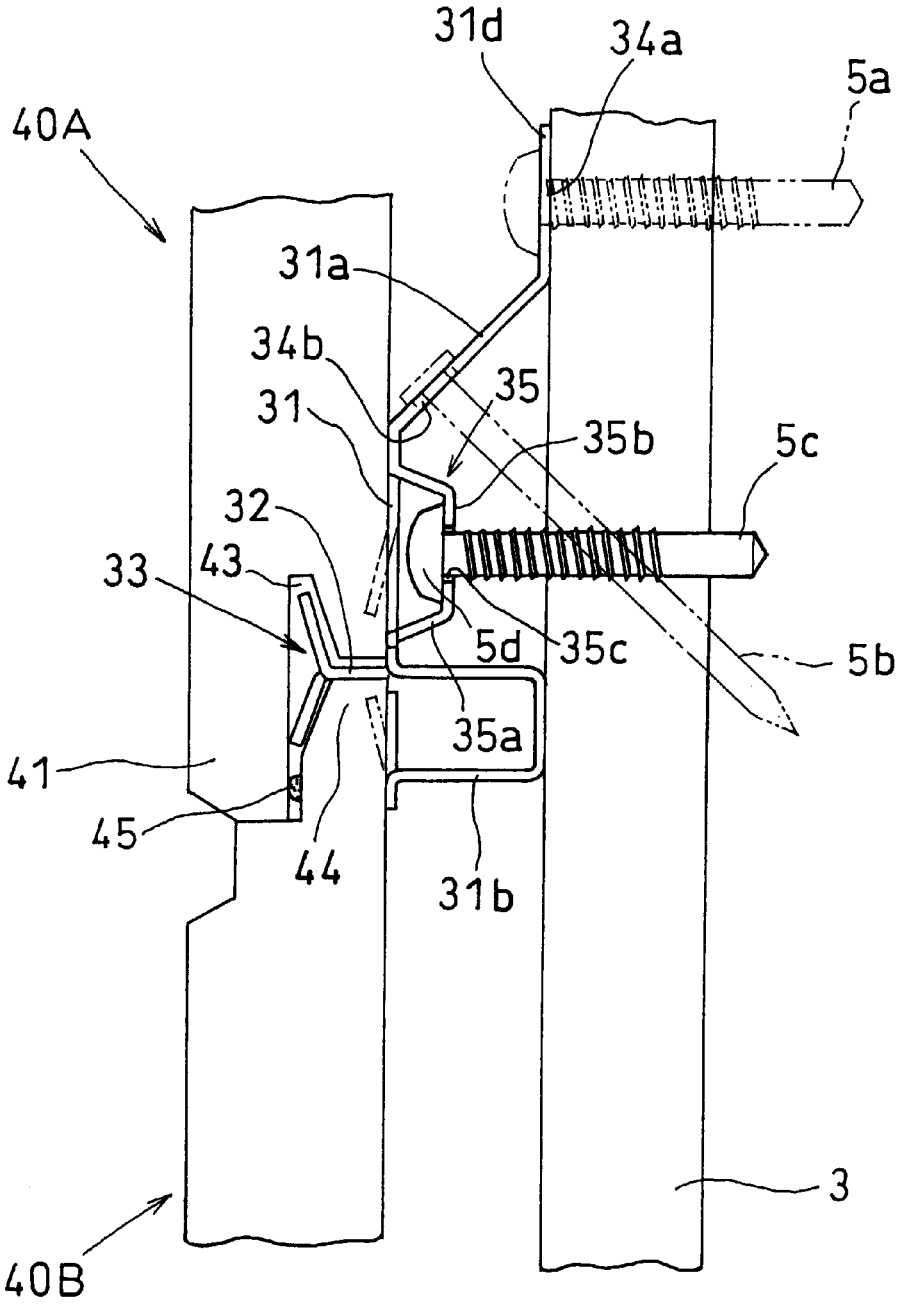
Fig. 9 Prior Art
FIG. 9 is an elevational sectional view illustrating the manner of using the fastening member shown in FIG. 8.

FIGS. 2 and 3 illustrate a fastened state of the building boards 40 shown in FIG. 7 which are installed by making use of the fastening member 10. Specifically, these siding boards 40A and 40B are fastened in the same manner as illustrated with reference to FIG. 9. The relationship between these siding boards 40A and 40B in the fastened state thereof is the same as illustrated with reference to FIG. 9. Therefore, the same members as indicated in FIG. 9 are identified by the same reference numerals thereby to omit the detailed explanation thereof.

As shown in FIG. 2, after the lower side of the engaging portion of the fastening member 10 is engaged with the underlying tongue engaging portion 44 of a lower building board 40B, the contacting portion 19 and the lower upstanding portion 20 are contacted with the studs 3 and at the same time, the fastening member 10 is pushed downward, thereby positioning the fastening member 10 in place. After this positioning of the fastening member 10, the distal end of fixing screw 5*c* is introduced into the opening 23 formed in the bottom 22*b* of the depressed portion 22 and horizontally screwed (in the direction of X) into the studs 3 by making use of a power tool (not shown). As a result, at the final stage of this screwing, the diametrically large head portion 5*d* of the fixing screw 5*c* is caused to be press-contacted with the upper surface 201 of the projected portion 200 which is formed at a lower wall portion of the conical inner wall 22*a* of the depressed portion 22 as shown in FIG. 2.

After this press-contact between the fixing screw 5*c* and the projected portion 200, the screwing of the fixing screw 5*c* is further continued to cause a component force in the vertical direction (in the direction Y) to be acted on the upper surface 201 of the projected portion 200, this action of component force being allowed to continue until the screwing work of the fixing screw 5*c* is finished. As a result, the fastening member 10 is pressed toward the building board 40B which has been fastened below the horizontal portion of the fastening member 10, thereby causing the fastening member 10 to move downward so as to be kept in a stabilized state.

Therefore, it is now possible to prevent the fixing member 10 from being inadvertently floated up by the vibration to be generated by the employment of a power tool, thus making it possible to realize a firmly fastened state between the fastening member 10 and the lower building board 40B. This effect can be realized irrespective of the workmanship of worker. By the way, when the underlying member (studs 3) is a wooden underlying member, the fixing member 10 may be nailed by making use of the opening 21 formed in the upper upstanding portion 18. When the fixing member 10 is nailed in this manner, the fastening member 10 to pushed toward the lower building board 40B which has been fastened below the horizontal portion of the fastening member 10, thereby realizing a stabilized fixed state of the fastening member 10.

FIG. 3 shows fastened states of another building board 40B which is to be disposed side by side and of another building board 40A which is to be disposed one upon another by making use of the fastening member 10 that has been fixed as shown in FIG. 2. The fastening member 10 is constructed such that the portion extending forward from the first inclined plane 13 and from the second inclined plane 15 is constituted by the vertical flat plate portion 14, so that when the building board 40 is fastened, this flat plate portion 14 is kept contacted with the rear surface of the overlying tongue pattern portion 41A of the upper siding board 40A. Therefore, the rain water flowing downward through the vertical gap S2 formed at the joint portion between the right and left building boards is caused to be discharged from this flat plate portion 14 toward the front surface of the building board, thereby preventing the rain water from leaking into the rear side of the building board.

Since these first horizontal portion 12 and second horizontal portion 16 are closely laminated each other and the vertical flat plate portion 14 is integrally attached to the distal ends of these horizontal members 12 and 16, these horizontal portions are highly resistive to the load of the siding board 40A which is to be mainly imposed on the upper edge of the vertical flat plate portion 14.

Since a couple of cut and raised portions 24*a* are formed as an urging means so as to press the siding board 40 through two rear surface portions thereof against the rear surface of the second inclined plane 15, the fastening between the siding board 40 and the fastening member 10 can be further stabilized. Moreover, since these cut and raised portions 24*a* are formed in such a manner that the bending direction (bent obliquely upward) thereof are directed opposite from each other, it is possible to effectively prevent the siding board 40 from being shifted or moved in the lateral (rightward or leftward) direction. Further, since these cut and raised portions 24*a* are formed at the distal end portions of the cantilever portions 29, respectively, it is possible to retain a more stable urging force against the building board.

The first substrate portion 11 is provided at the upper portion thereof with upstanding portions 18 which is extended rearward, while the second substrate portion 17 is provided at the lower portion thereof with upstanding portions 20 which is also extended rearward, thereby forming an air flow passageway Sc (see FIG. 2) between the building boards 40 being fastened and the underlying member (the studs 3). As a result, it is possible to prevent the condensation on the rear surface of the siding boards 40.

Figure 4:
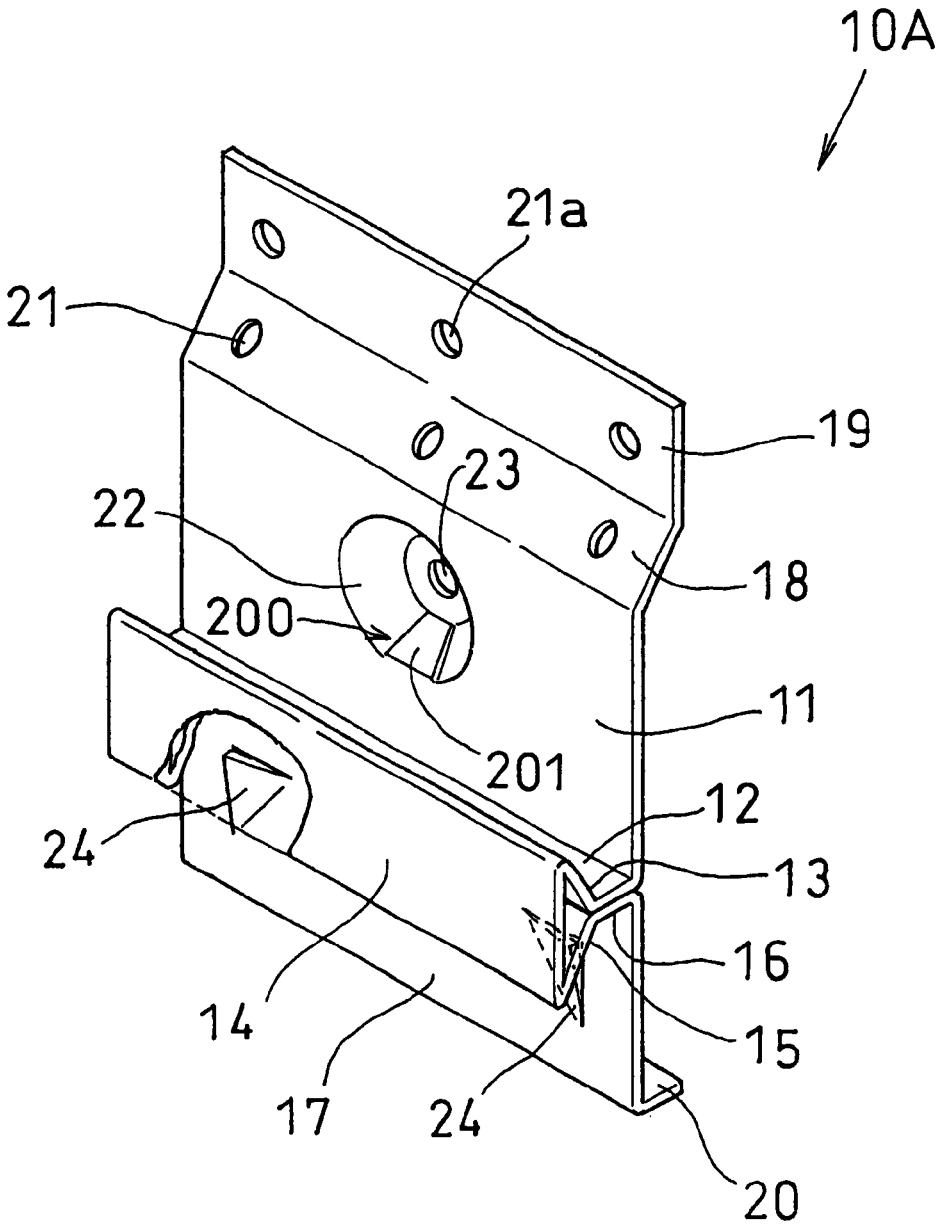
FIG. 4 is a perspective view illustrating a fastening member representing another embodiment of the present invention.
Figure 5:
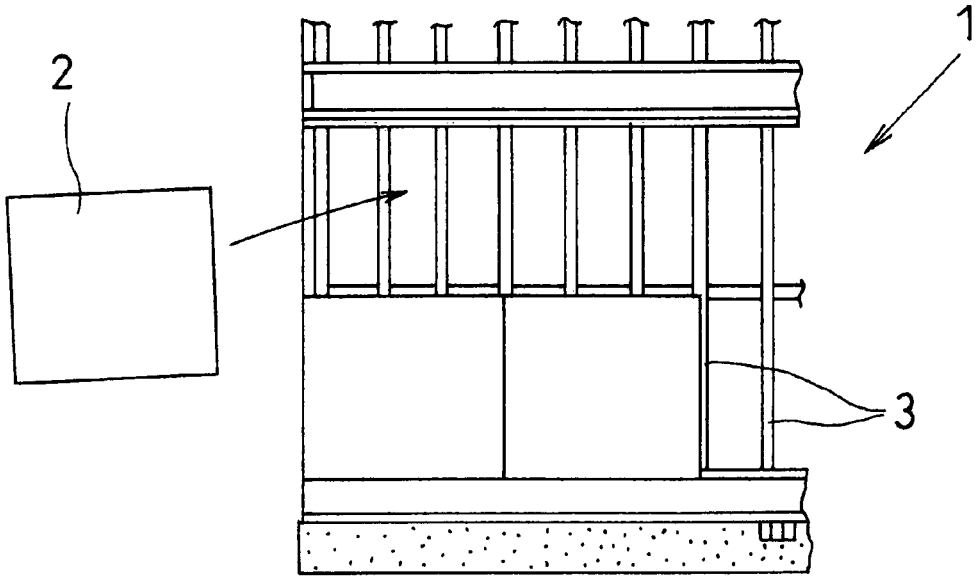
Fig. 5 Prior Art
FIG. 5 is a side view illustrating wood frame construction (two-by-four work)
Figure 6:
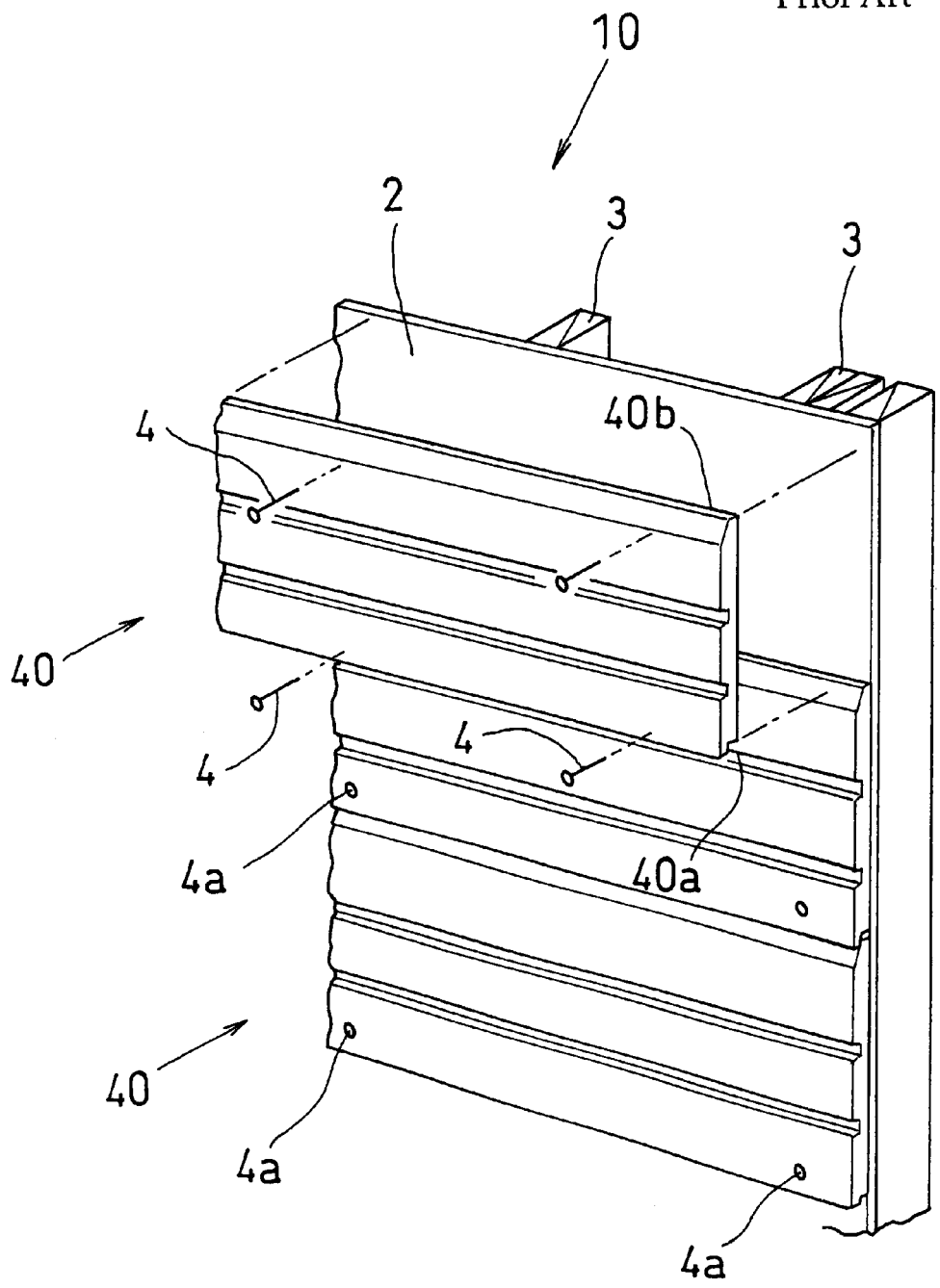
Fig. 6 Prior Art
FIG. 6 is a perspective view illustrating the fastening work of building boards according to the conventional wood frame construction.

FIG. 4 shows another embodiment of the fastening member according to the present invention. This fastening member 10A is the same as the fastening member 10 which has been explained with reference to FIG. 1 as far as the main structure thereof is concerned.

According to this embodiment, the holes 21*a* for introducing a fixing member are also formed in the contacting portion 19, thus making it possible to utilize the holes 21*a* as desired. Additionally, an L-shaped cut portion is formed at right and left sides of the second substrate portion 17, and these L-shaped cut portions are respectively bent, thereby forming a triangular raised portion 24 of simple structure, respectively.

According to the fastening member of the present invention, since a downwardly directed component force is always acted on the fastening member at the final stage of fixing the fastening member to an underlying member by means of a fixing member such as a screw, it possible, without necessitating a special attention, to reliably prevent the fastening member from being inadvertently floated up on the occasion of fixing the fastening member, thus ensuring always a stably fastened state of the building board.

Additionally, when the fastening member of the present invention is employed, the joined state between the building boards can be further strengthened, thereby making it possible to effectively inhibit the generation of disengagement between the building boards, thus bringing about a secondary effect of preventing the leakage of water through a gap between the building boards thus joined.

What is claimed is:

1. A fastening member for fastening building boards to a post or a stud of a building frame, comprising:

a substrate for supporting back surfaces of building boards;

at least two upstanding portions for stabilizing the fastening member against a post or a stud of a building frame, one of the at least two upstanding portions being inclined rearward from the upper edge of the substrate, and the other of which being extended rearward from the lower edge of the substrate;

a concave portion depressed rearward from the substrate for fixing the fastening member to a post or a stud of a building frame and having an inner wall, a bottom and an opening formed in the bottom for allowing a fixing member to pass therethrough, wherein a rear surface of the bottom of said concave portion and rear surfaces of ends of said upstanding portions are on the same plane;

a horizontal portion extending forward from the substrate; and an engaging portion for engaging ends of building boards, which is formed contiguous to the distal end of the horizontal portion;

wherein said inner wall of the concave portion is provided at a lower wall portion thereof with an obliquely projected portion which enables a component force directed downward to be acted via the fastening member on a lower building board which is held below said horizontal portion by allowing only said obliquely projected portion of said inner wall to be contacted with a head portion of the fixing member at a final stage of fixing the fixing member to a post or a stud of a building frame through said opening formed in said bottom, and by further screwing the fixing member with its head portion sliding on said obliquely projected portion.

2. The fastening member according to claim 1, wherein said inner wall of the concave portion is configured into a conical inner wall as a whole, and the obliquely projected portion is a lower portion of said inner wall whose inclination angle is partially altered.

3. The fastening member according to claim 1, wherein said inner wall of the concave portion is configured into a cylindrical inner wall as a whole, and the obliquely projected portion is a projection formed at a lower end portion of the cylindrical inner wall which is located in the vicinity of the bottom of the concave portion.

4. A fastening member for fastening building boards to a post or a stud of a building frame, comprising:

a substrate for supporting back surfaces of building boards;

at least two upstanding portions for stabilizing the fastening member against a post or a stud of a building frame, one of the at least two upstanding portions being inclined rearward from the upper edge of the substrate, and the other of which being extended rearward from the lower edge of the substrate;

a concave portion depressed rearward from the substrate or fixing the fastening member to a post or a stud of a building frame and having an inner wall, a bottom and an opening formed in the bottom for allowing a fixing member to pass therethrough, wherein a rear surface of the bottom of said concave portion and rear surfaces of ends of said upstanding portion are on the same plane;

a horizontal portion extending forward from the substrate; and an engaging portion for engaging ends of building boards, which is formed contiguous to the distal end of the horizontal portion;

wherein said inner wall of the concave portion is provided at a lower wall portion thereof with an obliquely projected portion which enable a component force directed downward to be acted via the fastening member on a lower building board which is held below said horizontal portion by allowing only said obliquely projected portion of said inner wall to be contacted with a head portion of the fixing member at a final stage of fixing e fixing member to a post or a stud of a building frame through said opening formed in said bottom, and by further screwing the fixing member with its head portion sliding on said obliquely projected portion, wherein said horizontal portion consists a first and a second horizontal portions which are contacted with each other to form a laminated structure.

5. The fastening member according to claim 4, wherein said first and second horizontal portions are joined by being partly welded.

6. The fastening member according to claim 1, wherein said engaging portion comprises;

a first inclined portion which obliquely extends forward an upward from the front end of said first horizontal portion to be engaged with the upper building board;

a vertical flat plate portion which extends vertically downward from the upper end of the first inclined portion to be contacted with the rear surface of the upper building board;

a second inclined portion which obliquely extends backward and upward from the lower end of the vertical flat plate portion to be engaged with the lower building board.

7. The fastening member according to claim 1, which is formed of a single plate.

* * * * *